US010464654B2

(12) United States Patent
Lehmann et al.

(10) Patent No.: US 10,464,654 B2
(45) Date of Patent: Nov. 5, 2019

(54) RUDDER BLADE WITH A RUDDER BLADE HUB AND RUDDER BLADE HUB FOR A RUDDER BLADE

(71) Applicant: becker marine systems GmbH, Hamburg (DE)

(72) Inventors: Dirk Lehmann, Hamburg (DE); Herbert Blümel, Hamburg (DE)

(73) Assignee: becker marine systems GmbH, Hamburg (DE)

( * ) Notice: Subject to any disclaimer, the term of this patent is extended or adjusted under 35 U.S.C. 154(b) by 0 days.

(21) Appl. No.: 15/991,606

(22) Filed: May 29, 2018

(65) Prior Publication Data

US 2018/0346087 A1 Dec. 6, 2018

(30) Foreign Application Priority Data

May 30, 2017 (EP) ..... 17173460

(51) Int. Cl.
*B63H 25/38* (2006.01)

(52) U.S. Cl.
CPC ..... *B63H 25/38* (2013.01)

(58) Field of Classification Search
CPC ..... B63H 25/38
See application file for complete search history.

(56) References Cited

U.S. PATENT DOCUMENTS 2,386,803 A * 10/1945 Jutte ..... B63H 25/38
114/162

* cited by examiner

*Primary Examiner* — Stephen P Avila
(74) *Attorney, Agent, or Firm* — Kelly & Kelley, LLP

(57) ABSTRACT

A rudder blade includes a leading edge, a trailing edge, a first side wall and a second side wall lying opposite the first side wall, and a rudder blade hub, which is arranged in a connection space, for connecting a rudder stock. The rudder blade hub has a hub body including an inner bore for receiving the rudder stock, and a hub outer surface running in the circumferential direction, for the hub outer surface to be entirety spaced apart from an inner side of the first side wall and from an inner side of the second side wall.

17 Claims, 5 Drawing Sheets

RUDDER BLADE WITH A RUDDER BLADE HUB AND RUDDER BLADE HUB FOR A RUDDER BLADE

The present invention relates to a rudder blade, in particular for a semi-balanced rudder or a full spade rudder, for water crafts, in particular ships, comprising a leading edge, a trailing edge, a first side wall and a second side wall lying opposite the first side wall, and a rudder blade hub, which is arranged in a connection space, for connecting a rudder stock, wherein the rudder blade hub comprises a hub body, wherein the hub body comprises an inner bore for receiving a rudder stock, and a hub outer surface running in the circumferential direction. Furthermore, the present invention relates to a rudder blade hub for a rudder blade.

PRIOR ART

For changing the direction of travel, water crafts, in particular ships, have a rudder which is generally arranged at the stern. A rudder for a water craft comprises a rudder blade which is mounted rotatably on the hull by means of a rudder stock. A rudder blade hub is provided in the rudder blade for connecting the rudder stock to the rudder blade.

Rudder blades, in particular for semi-balanced rudders or full spade rudders for water crafts, in particular for large ships, such as container ships or oil tankers, can have an overall weight of significantly above 100 tonnes, wherein the rudder blade hub can make up up to 20% of said overall weight. The rudder blade hub is arranged in a connection space provided in the interior of the rudder blade. The connection space can be limited in the vertical direction and in the directions of the leading edge and of the trailing edge by horizontal and vertical ribs of a skeleton structure imparting strength to the rudder blade. In the direction of the outer side of the rudder blade, the connection space is generally limited by a partial region of the respective adjacent side wall of the rudder blade. In order to produce the required strength of the rudder blade connection and in order to absorb and conduct away the high forces and torques acting on the rudder blade during operation, rudder blade hubs known from the prior art are dimensioned in such a manner that they lie against the inner sides of the side walls of the rudder blade with the hub outer surface. Forces acting on the side walls are thereby conducted away directly onto the rudder blade hub and the rudder stock. However, because of the large profile thicknesses of rudders for large ships, the known rudder blade hubs are overdimensioned in respect of the connection and mounting of the rudder blade. Known rudder blade hubs are therefore very heavy material- and cost-intensive components.

In addition, known rudder blades are frequently provided with what are referred to as welding windows which are arranged in the side walls of the rudder blade in the region of the rudder blade hub. The rudder blade hub extends with its hub outer surface partially through the welding windows and then has to be welded in a complicated manner to the side walls of the rudder blade. The rudder blade hub together with its hub outer surface then forms part of the outer wall of the rudder blade.

SUMMARY OF THE INVENTION: OBJECT, SOLUTION, ADVANTAGES

The object of the present invention is to provide a rudder blade with a rudder blade hub, which, in comparison to rudder blades known from the prior art, has a lower overall weight and can be produced with a reduced outlay on materials and costs, while simultaneously ensuring a sufficiently high strength in order to be able to absorb the large forces and torques acting during operation of the rudder blade and to be able to conduct them away to a rudder stock. Furthermore, the object of the invention is to provide a rudder blade hub for a rudder blade, which is lighter than known rudder blade hubs and can be produced with a lower outlay on materials and costs.

In order to achieve the object, a rudder blade is proposed, in particular for a semi-balanced rudder or a full spade rudder, for water craft, in particular ships, comprising a leading edge, a trailing edge, a first side wall and a second side wall lying opposite the first side wall, and a rudder blade hub, which is arranged in a connection space, for connecting a rudder stock, wherein the rudder blade hub comprises a hub body, wherein the hub body comprises an inner bore for receiving a rudder stock, and a hub outer surface running in the circumferential direction, wherein the hub outer surface is furthermore arranged in its entirety spaced apart from an inner side of the first side wall and from an inner side of the second side wall.

Within the context of the present invention, a rudder blade hub is understood as meaning a workpiece or component which has an inner bore in which the rudder stock can be accommodated. The rudder stock can be connected fixedly to the rudder blade hub, in particular in a form-fitting, force-fitting or integrally bonded manner, such that torques can be transmitted between the rudder blade hub and the rudder stock. The fixed connection can be undertaken by driver elements, such as feather keys or wedges. Furthermore, the rudder blade hub can be connected to the rudder stock by means of a press fit, a shrink disc, a clamping set or an interference fit. It is also possible for the rudder blade hub to be braced to the rudder stock by means of a nut. The inner bore and that end of the rudder stock which is insertable into the inner bore can be of conical design. The rudder blade hub is preferably arranged completely in the rudder blade, and preferably no portions of the rudder blade hub protrude from the rudder blade.

In the state arranged on the water craft, the leading edge of the rudder blade is arranged facing the bow, or if there is a propeller, facing the propeller of the ship. The trailing edge of the rudder blade is arranged lying opposite the leading edge and facing away from the bow or the propeller. A first side wall and a second side wall lying opposite the first side wall extend between trailing edge and leading edge and form the outer wall of the rudder blade. The rudder blade is substantially symmetrical with respect to a centre plane which runs vertically when the rudder blade is arranged on the ship, and is approximately defined by the quantity of skeleton lines of the individual profile sections of the rudder blade. There may be slight deviations from the symmetry of the rudder blade with respect to the centre plane if, for example, the leading edge and/or the trailing edge of the rudder blade is or are twisted or skewed, that is to say if the leading edge or the trailing edge is pretensioned in relation to the propeller wake flow in order to prevent cavitation and to recover energy. In the case of a twisted rudder blade, the leading edge or the trailing edge can be twisted or pretensioned towards the starboard side in an upper rudder blade portion and towards the port side in a lower rudder blade portion or vice versa.

A connection space which is preferably bounded by the side walls or by partial regions of the side walls of the rudder blade is provided in the interior of the rudder blade. The connection space is preferably bounded upwards and downwards in the vertical direction by horizontal ribs of a skeleton structure of the rudder blade. A rudder blade hub for the connection of a rudder stock is arranged in the connection space. For this purpose, a rudder stock can be inserted into the inner bore of the hub body of the rudder blade hub. In order to fasten the rudder stock to the rudder blade hub and therefore to the rudder blade, a fastening means, such as, for example, a hydraulic screw, can be provided.

The hub outer surface is advantageously arranged in its entirety spaced apart from an inner side of the first side wall and from an inner side of the second side wall. In a profile section perpendicularly to the centre plane of the rudder blade, that is to say in a cross section of the rudder blade in the direction of flow of the water, when the rudder blade is arranged on the ship, through the connection space, the rudder blade hub is arranged in the interior of the connection space in such a manner that the hub outer surface is arranged spaced apart at every point of the circumference of the hub body from the inner side of the first side wall and from the inner side of the second side wall.

In contrast to rudder blade hubs which are known from the prior art and the hub outer surfaces of which, running in the circumferential direction, are arranged lying against the inner side of the first side wall and the inner side of the second side wall, the rudder blade hub of the rudder blade according to the invention is of significantly smaller dimensions. This has the advantage that less material has to be used for the rudder blade hub, with the consequence that the overall weight of the rudder blade is reduced and that the production costs are reduced.

It is advantageously possible to save up to 10% or more of the overall weight of the rudder blade by means of the rudder blade hub which is arranged with the hub outer surface spaced apart from the side walls.

It is preferably provided that the hub outer surface is arranged spaced apart from the inner side of the first side wall and from the inner side of the second side wall over the entire axial height of the rudder blade hub, and/or that the hub outer surface does not have any physical contact with the inner side of the first side wall and the inner side of the second side wall.

The axial height of the rudder blade hub is measured here along the longitudinal axis of the rudder blade hub, wherein the longitudinal axis of the rudder blade hub runs in the direction of a rudder stock to be arranged in the rudder blade hub. If the hub outer surface is arranged spaced apart from the inner side of the first side wall and the inner side of the second side wall over the entire axial height of the rudder blade hub, material can be saved not only in the circumferential direction of the hub body, but also over the axial height of the rudder blade hub, the axial height running perpendicularly to the circumferential direction.

If the hub outer surface in particular does not have any physical contact with the inner side of the first side wall and the inner side of the second side wall, the outlay on materials and costs can be further reduced.

The rudder blade hub, in particular the hub body, is optionally connected, in particular welded, with front sides arranged on the end side, as seen in the direction of the longitudinal axis of the rudder blade hub, a first or lower and a second or upper front side, to ribs of the rudder blade. By means of this measure, the forces and torques acting on the rudder blade during operation are transmitted to or conducted away from the rudder blade hub and the rudder stock.

Furthermore, it can advantageously be provided that the hub body has an outer diameter, that the connection space comprises a first outer wall, wherein the first outer wall is a partial region of the first side wall, that the connection space comprises a second outer wall, wherein the second outer wall is a partial region of the second side wall, that the connection space has an inner distance between an inner side of the first outer wall and an inner side of the second outer wall, wherein the outer diameter of the hub body is smaller than the inner distance.

The connection space of the rudder blade is preferably a partial volume of the rudder blade. The connection space is bounded here in the vertical direction by partial regions of horizontal ribs of the rudder blade, wherein the horizontal ribs lie in the planes of the profile sections. The connection space is bounded to the outer sides of the rudder blade by partial regions of the first side wall and of the second side wall which form the outer walls of the connection space. In the direction of the connecting line between leading edge and trailing edge, further ribs running perpendicularly in the rudder blade, or partial regions of ribs can forwardly bound the connection space in the direction of the leading edge or rearwardly bound same in the direction of the trailing edge. The connection space is of approximately cuboidal design and is preferably located approximately in the centre of the rudder blade. There can be slight deviations of the connection space from the cuboidal form by means of the profile-induced slight curvature of the side walls or of the outer walls of the connection space. In principle, the connection space can also be designed differently than cuboidally.

In addition, the connection space is preferably located in the region of the greatest profile thickness of the rudder blade and has a width which is defined by the inner distance of the inner side of the first outer wall from the inner side of the second outer wall. If the rudder blade hub is advantageously formed with an outer diameter which is smaller than said inner distance, the rudder blade hub can be arranged in the interior of the connection space in such a manner that it does not have any physical contact with the first outer wall and/or with the second outer wall. Consequently, the rudder blade hub has smaller dimensions than rudder blade hubs, which are known from the prior art, for rudder blades. By means of this measure, the outlay on materials and the production costs of the rudder blade are reduced further.

It is preferably provided that the rudder blade hub comprises at least one connecting means, preferably a plurality of connecting means, wherein the at least one connecting means extends between the hub outer surface and the inner side of the first side wall, in particular the first outer wall, and/or the inner side of the second side wall, in particular the second outer wall, wherein the rudder blade hub preferably comprises at least two connecting means, wherein a first connecting means extends between the hub outer surface and the inner side of the first side wall, in particular the first outer wall, and wherein a second connecting means extends between the hub outer surface and the inner side of the second side wall, in particular the second outer wall.

The at least one connecting means produces a connection between the rudder blade hub, in particular the hub outer surface of the hub body, and the first side wall and/or the second side wall or the first outer wall and/or the second outer wall of the connection space. Forces and torques acting on the rudder blade or the rudder blade outer wall during operation are transmitted from the side walls or the outer walls of the connection space to the at least one connecting means which transfers said forces and loadings via the hub outer surface to the hub body of the rudder blade hub. This increases the strength of the rudder blade and sufficiently conducts away the rudder forces and torques to the rudder stock via the rudder blade hub, with a simultaneous reduction in the outlay on material and the production costs. In comparison to rudder blades which are known from the prior art and have rudder blade hubs, the preferred rudder blade hub can therefore be dimensioned and designed to be smaller and lighter without the strength of the rudder blade being impaired. Contrary to the rudder blades known from the prior art, rudder forces and torques are no longer transmitted directly via the hub outer surface, which is in physical contact with the side walls, but instead transferred via the connecting means from the side walls of the rudder blade to the hub body of the rudder blade hub. The weight of the at least one connecting means is lower here than the material saving achieved by reducing the size of the rudder blade hub. In addition, a welding window advantageously no longer has to be provided in the side wall of the rudder blade, so that the complicated welding of the rudder blade hubs known from the prior art to the side walls of the rudder blade or to the outer wall of the rudder blade is also omitted.

If at least two connecting means are provided, a first connecting means can extend between the hub outer surface and the inner side of the first side wall, in particular the first outer wall, and a second connecting means can extend between the hub outer surface and the inner side of the second side wall, in particular the second outer wall. By means of this measure, the strength of the rudder blade is increased further and the material and production costs are reduced further.

If a plurality of connecting means are provided, each connecting means preferably extends between the hub outer surface and either the inner side of the first side wall, in particular the first outer wall, or the inner side of the second side wall, in particular the second outer wall.

In principle, a configuration of the rudder blade and of the rudder blade hub is also conceivable, in which the hub body with the hub outer surface is in physical contact with the inner side of the first side wall, in particular the first outer wall, and/or with the inner side of the second side wall, in particular the second outer wall, or in which the hub outer surface is not spaced apart from the inner sides of the side walls, and wherein the rudder blade hub comprises at least one connecting means.

Preferably, the at least one connecting means is designed to transmit forces and/or torques acting on the rudder blade, in particular on the side walls of the rudder blade, in particular during operation and when the rudder blade is arranged on the ship, to the rudder blade hub, in particular to the hub body.

The hub body can therefore be of smaller dimensions. The rudder blade strength which is reduced because of the reduction in material of the hub body and the absence of the direct connection of the hub body to the side walls is compensated for by means of the arrangement of the at least one connecting means.

With further advantage, the at least one connecting means comprises a first connecting region and a second connecting region, wherein the at least one connecting means is arranged and/or fastened with the first connecting region on/to the hub outer surface, and wherein the at least one connecting means is arranged and/or fastened with the second connecting region on/to the inner side of the first side wall, in particular the first outer wall, and/or on/to the inner side of the second side wall, in particular the second outer wall.

In other words, the connecting means comprises two connecting regions which are designed for connection to the hub outer surface and/or the inner side of the first side wall, in particular the first outer wall, and/or the inner side of the second side wall, in particular the second outer wall. In the event that a plurality of connecting means are provided, each connecting means preferably comprises a first connecting region and a second connecting region. Each connecting means is then arranged and/or fastened with the first connecting region on/to the hub outer surface. Depending on the position along the circumference of the hub body, the individual connecting means is then preferably arranged or fastened with the second connecting region either on/to the inner side of the first outer wall or on/to the inner side of the second outer wall.

For example, a connecting means can be arranged on a first side of the centre plane of the rudder blade, which side corresponds, for example, to the starboard side in the state arranged on the ship. Said connecting means is then arranged and/or fastened with the second connecting region on/to the inner side of the starboard-side outer wall. A further connecting means can be arranged on the second side, which lies opposite the first side, of the centre plane, that is to say on the port side when the rudder blade is arranged on the ship. This connecting means is then arranged and/or fastened with the second connecting region on/to the inner side of the port-side outer wall.

It is preferably provided that at least two connecting means are provided, wherein the at least two connecting means are arranged symmetrically or asymmetrically with respect to a centre plane of the rudder blade, and/or that an equal number of connecting means are arranged on both sides of the centre plane, and/or that the number of connecting means which extend between the hub outer surface and the inner side of the first side wall, in particular the first outer wall, is equal to the number of connecting means which extend between the hub outer surface and the inner side of the second side wall, in particular the second outer wall.

The centre plane which runs approximately from the leading edge to the trailing edge divides the rudder blade into two regions arranged approximately symmetrically with respect to each other, wherein deviations from the symmetry can occur, for example, by means of a twisted or skewed leading edge or by means of a twisted or skewed trailing edge. The centre plane of the rudder blade preferably runs through the longitudinal axis of the rudder blade hub or of the hub body, wherein the longitudinal axis in turn runs centrally in the inner bore of the hub body. If a plurality of connecting means are provided, the latter are preferably arranged symmetrically on both sides of the centre plane. This advantageously results in a uniform absorption and transfer of the forces acting on the rudder blade during operation. In an advantageous manner, the same number of connecting means are arranged on both sides of the centre plane, that is to say, when the rudder blade is arranged on the ship, both on the starboard side and on the port side of the rudder blade. This measure also leads to an increase in the strength and to an improvement in the absorption and the transfer of rudder forces and rudder torques occurring during operation to the rudder blade hub and to a rudder stock.

However, it can also be provided that the at least two connecting means are arranged asymmetrically with respect to a centre plane of the rudder blade. An asymmetrical arrangement is advantageous in particular in the case of a twisted rudder blade.

The connecting means which are arranged on one side of the centre plane, are particularly preferably in each case arranged completely on said side, that is to say, the connecting means are not simultaneously arranged with any of their partial regions on both sides of the centre plane.

It is preferably provided that the at least one connecting means extends over at least 60%, preferably at least 70%, furthermore preferably at least 80%, in particular preferably at least 90%, very particularly preferably over 100%, of the axial height of the rudder blade hub and is arranged and/or fastened on/to the hub outer surface preferably over at least 60%, preferably at least 70%, furthermore preferably at least 80%, in particular preferably at least 90%, very particularly preferably over 100%, of the axial height.

Furthermore, it can be provided that the at least one connecting means is arranged and/or fastened on/to the inner side of the first side wall, in particular the first outer wall, and/or on/to the inner side of the second side wall, in particular the second outer wall, over at least 60%, preferably at least 70%, furthermore preferably at least 80%, in particular preferably at least 90%, very particularly preferably over 100%, of the axial height of the rudder blade hub.

The axial height of the rudder blade hub is measured in the direction of the longitudinal axis of the rudder blade hub, wherein the longitudinal axis of the rudder blade hub runs through a centre axis of the inner bore of the hub body and corresponds to the direction of a rudder stock arranged in the rudder blade hub. If the at least one connecting means advantageously extends over the entire axial height along the rudder blade hub, in particular the hub body, and is preferably arranged and/or fastened on/to the hub outer surface over the entire axial height, a particularly stable connection of the rudder blade hub via the hub outer surface of the hub body to the inner side of the first side wall and to the inner side of the second side wall is made possible.

Furthermore preferably, it is provided that the at least one connecting means is a web and/or a plate and/or a strut.

The at least one connecting means is preferably of approximately cuboidal design. This shape can be produced with little outlay on material and particularly cost-effectively. In addition, an approximately cuboidal configuration of the at least one connecting means in the form of a web, a plate or a strut permits a particularly efficient transmission of the rudder forces and torques occurring during operation to the hub body of the rudder blade hub.

Very particularly preferably, it can be provided that the at least one connecting means, in particular the web, the plate or the strut, runs vertically, that is to say that the at least one connecting means, in particular the web, the plate or the strut, runs parallel to the longitudinal axis of the rudder blade hub and is arranged and/or fastened on/to the hub outer surface. In a top view of the rudder blade hub along the longitudinal axis, the at least one connecting means, in particular the web, the plate or the strut, preferably runs in a radial direction outwards from the hub outer surface of the hub body in the direction of the inner side of the first side wall, in particular the first outer wall, and/or in the direction of the inner side of the second side wall, in particular the second outer wall.

A radial arrangement of the at least one connecting means and/or a substantially vertical extent parallel to the longitudinal axis of the rudder blade hub permits a particularly simple design of the connecting means in the form of cuboidal components and also ensures a highly efficient transmission of rudder forces and rudder torques from the outer wall of the rudder blade or the side walls to the rudder blade hub.

However, it is also possible for the at least one connecting means, in particular the web, the plate or the strut, not to run or be arranged in a radial direction outwards from the hub outer surface of the hub body in the direction of the inner side of the first side wall, in particular the first outer wall, and/or in the direction of the inner side of the second side wall, in particular the second outer wall.

The at least one connecting means, in particular the web, the plate or the strut, can also be at an angle with respect to a radial of the hub body, i.e. with respect to a radial direction from the hub outer surface of the hub body in the direction of the inner side of the first side wall and/or in the direction of the inner side of the second side wall, and can therefore have an angle with respect to the radial.

The at least one connecting means can also have an arcuate profile or a bend, as seen in particular in the direction of the longitudinal axis of the rudder blade hub. The at least one connecting means can have the arcuate profile or the bending profile in sections or over its entire vertical extent. Furthermore, the at least one connecting means can also have an arcuate profile or a bend with respect to the radial in a top view of the rudder blade hub along the longitudinal axis.

Furthermore preferably, it is provided that between two and ten, furthermore preferably between two and six, particularly preferably four, connecting means are provided, wherein the connecting means are very particularly preferably arranged symmetrically or asymmetrically with respect to the centre plane of the rudder blade and/or are arranged distributed, preferably uniformly, over the circumference of the hub body.

It is particularly advantageous if four connecting means are provided, wherein the connecting means are arranged symmetrically with respect to the centre plane of the rudder blade and/or are arranged distributed over the circumference of the hub body. In the preferred arrangement, two of the four connecting means are therefore arranged on a first side of the centre plane, for example on the starboard side, whilst two further connecting means are arranged on a second side of the centre plane, for example on the port side. The two connecting means on the starboard side are arranged here symmetrically to the connecting means on the port side with respect to the centre plane of the rudder blade. In the case of four connecting means, it can be provided in particular that the connecting means are arranged distributed uniformly over the circumference of the hub body. This means that, in the case of four connecting means, the angular distance between adjacently arranged connecting means is 90°, as seen in a top view of the hub body along the longitudinal axis.

This gives rise overall to a symmetrical rudder blade hub comprising a hub body and four connecting means that can be produced in a particularly simple manner and provides the rudder blade with particularly good strength.

In an advantageous manner, at least two connecting means are provided, wherein the at least two connecting means have an angular distance of 0° to 90°, preferably of 30° to 80°, furthermore preferably of 50° to 70°, particularly preferably of 55° to 65°, from the centre plane of the rudder blade, and/or wherein the at least two connecting means have an angular distance of 0° to 90°, preferably of 10° to 60°, furthermore preferably of 20° to 40°, particularly preferably of 25° to 35°, from a transverse plane running perpendicularly to the centre plane of the rudder blade and through a longitudinal axis of the rudder blade hub.

The transverse plane running perpendicularly to the centre plane and through the longitudinal axis of the rudder blade hub divides the rudder blade into a front region, which comprises the leading edge, and a rear region, which comprises the trailing edge. In addition, the transverse plane is perpendicular to the centre plane and the profile planes. If the rudder blade hub is arranged in the region of the greatest profile thickness, the transverse plane at the same time includes the plane of the greatest profile thickness.

The angular distance of the connecting means can be measured either with respect to the centre plane or with respect to the transverse plane. If the angular distance of a connecting means is 90° with respect to the centre plane of the rudder blade, the connecting means lies substantially in the transverse plane. Depending on the configuration of the rudder blade, that is to say, depending on the profile shape thereof, and depending on the forces and loadings to be anticipated during operation of the rudder blade, it can be advantageous for the connecting means to have a distance of 50° to 70° from the centre plane.

It is preferably provided that in each case two connecting means are arranged on each side of, and in particular symmetrically with respect to, the centre plane, wherein the angular distance between the two connecting means arranged on the respective side is between 20° and 120°, preferably between 40° and 80°, particularly preferably between 50° and 70°, in particular preferably between 55° and 65°.

Furthermore preferably, it can be provided that the at least one connecting means is welded and/or adhesively bonded to the hub body, in particular the hub outer surface, and/or to the side walls of the rudder blade, in particular to the outer walls and/or is forged thereon.

The at least one connecting means can be welded and/or adhesively bonded to the hub body, in particular to the hub outer surface and/or to the outer walls, that is to say that the connecting means is welded or adhesively bonded with the first connecting region to the hub body, in particular to the hub outer surface, and is welded or adhesively bonded with the second connecting region to the first side wall, in particular the first outer wall, or to the second side wall, in particular the second outer wall. Welding of the connecting means to the hub body or to the hub outer surface and/or to the side walls or the outer walls can be carried out particularly simply and cost-effectively.

It can furthermore be preferred that the hub body is formed in a rotationally symmetrical manner with respect to a longitudinal axis of the rudder blade hub, wherein the hub body is preferably of cylindrical or conical design.

The wall thickness of the hub body can be constant or can increase or decrease here in the axial direction along the longitudinal axis.

It is furthermore preferably provided that the rudder blade comprises ribs, that the hub body comprises a lower front side and an upper front side, and that the hub body is fastened, in particular welded, with the lower front side to a first lower rib, and/or that the hub body is fastened, in particular welded, with the upper front side to a second upper rib.

On the end sides, the hub body has an upper front side and a lower front side, as seen in the axial direction, wherein the terms "top" and "bottom" refer to the state of the rudder blade arranged in a ship. In addition, the rudder blade preferably comprises an inner skeleton structure which is formed by ribs oriented horizontally and vertically. The rudder blade here can comprise two to fifty, preferably four to ten, ribs. The horizontal ribs run from the leading edge as far as the trailing edge and are clamped between the first side wall and the second side wall and are oriented substantially parallel to the profile planes. A first lower rib bounds the connection space from below and a second upper rib bounds the connection space from above. To the sides, the connection space can be bounded by the outer wall of the connection space or by the partial regions of the side walls. The connection space can furthermore be bounded forwards or rearwards, as seen in the direction of travel, by a first vertical rib and a second vertical rib. By means of the bounding of the connection space by the side walls and the vertical and horizontal ribs or the upper rib and the lower rib, the connection space is of approximately cuboidal design. The axial height of the rudder blade hub is then advantageously selected in such a manner that it corresponds to the height of the connection space, and therefore the rudder blade hub or the hub body lies with the upper end side against the lower side of the upper rib and with the lower end side against the upper side of the lower rib. In order to achieve greater strength, the rudder blade hub or the hub body can be connected to the upper rib and to the lower rib, for example by welding. The forces and torques acting on the rudder blade during operation are then not only transmitted to the rudder blade hub via the connecting means, but are also transmitted to the rudder blade hub, and therefore also to the rudder stock, via the ribs, in particular via the upper rib and the lower rib. This results in a further increase in the strength of the rudder blade.

It is preferably provided that the at least one connecting means is fastened, in particular welded, with a first end side to the first lower rib, and/or that the at least one connecting means is fastened, in particular welded, with a second end side lying opposite the first end side to the second upper rib.

The at least one connecting means can be designed as an approximately cuboidal plate, web or strut and is in particular preferably arranged and/or fastened on/to the hub outer surface of the hub body of the rudder blade hub in a manner protruding in the radial direction. As seen in the vertical direction, that is to say along the longitudinal axis of the rudder blade hub, each connecting means or each web, plate or strut, comprises a first lower end side and a second upper end side lying opposite the first end side. The length of the connecting means, as seen in the direction of the longitudinal axis of the rudder blade hub, is preferably identical here to the axial height of the rudder blade hub or of the hub body, and therefore the connecting means, in particular the web, the plate or the strut, lies with the first end side against the lower rib and with the second end side against the upper rib. By fastening or welding the connecting means with the ribs to the first end side and/or to the second end side, a further increase in the strength of the rudder blade is achieved.

It is preferably provided that the first lower rib and/or the second upper rib comprisean opening, wherein the diameter of the opening is smaller than the outer diameter of the hub body and larger than the inner diameter of the inner bore of the hub body, wherein the opening is bordered by a flange, and wherein the rudder blade hub is fastened, preferably welded, to the flange, in particular in an encircling manner.

By means of the advantageous provision of an opening, in particular in the second upper rib, a rudder stock can be inserted from above into the connection space and into the rudder blade hub, which is arranged in the connection space, or into the inner bore of the hub body of the rudder blade hub. An opening in the lower rib makes it possible to guide the rudder stock through the rudder blade hub and out of the connection space and to secure same in the rudder blade by means of a fastening element, such as, for example, a hydraulic screw. That region of the upper rib or of the lower rib that bounds the connection space is then designed in the form of a flange on which the rudder blade hub can be supported. The flange can also be welded or forged here to the side walls or to the vertical ribs bounding the connection space forward and rearward.

The lower front surface and/or the upper front surface of the rudder blade hub or of the hub body advantageously comprises a step encircling in the circumferential direction or a shoulder, and therefore the rudder blade hub with the front surfaces of the hub body can be inserted into the opening in the upper rib or the lower rib in such a manner that the hub body, with the step of the lower front side, engages in the opening in the lower rib and/or, with the step of the upper front side, engages in the opening of the upper rib. By means of this measure, welding stresses are avoided.

The rudder blade hub can preferably also be fastened to the upper and/or to the lower rib via a welding connection with a transition radius. For this purpose, a projection or flange can be provided in the region of the upper and/or the lower front surface, said projection or flange encircling the hub outer surface on the outer side and lying with an outer surface against an inner side of the opening in the upper and/or in the lower rib and being welded to the upper and/or the lower rib. The hub body projects here on the end side into the opening in the upper and/or the lower rib in each case over a length approximately corresponding to the height of the projection. This connection of rudder blade hub and lower and/or upper rib is simple to produce.

If more than one connecting means are provided, each individual connecting means can be designed like the above-described at least one connecting means.

It is furthermore advantageously provided that the ratio of the outer diameter of the hub body to an inner diameter of the inner bore is between 1.0 and 2.0, preferably between 1.2 and 1.5, furthermore preferably between 1.25 and 1.45.

The ratio of outer diameter of the hub body to inner diameter of the inner bore is therefore advantageously significantly smaller than in the case of rudder blade hubs known from the prior art. Accordingly, a large saving on material and a significant reduction in the costs can be achieved.

The object on which the invention is based is furthermore achieved by the provision of a rudder blade hub for an above-described rudder blade.

The rudder blade hub preferably comprises a hub body and connecting elements, wherein the connecting elements are designed according to one of the above-described embodiments.

The object on which the invention is based is furthermore achieved by the provision of a construction kit for an above-described hub comprising a hub body and at least one connecting element.

BRIEF DESCRIPTION OF THE FIGURES

The invention is explained in more detail below with reference to the figures, in which.

DETAILED DESCRIPTION OF THE FIGURES

Figure 1:
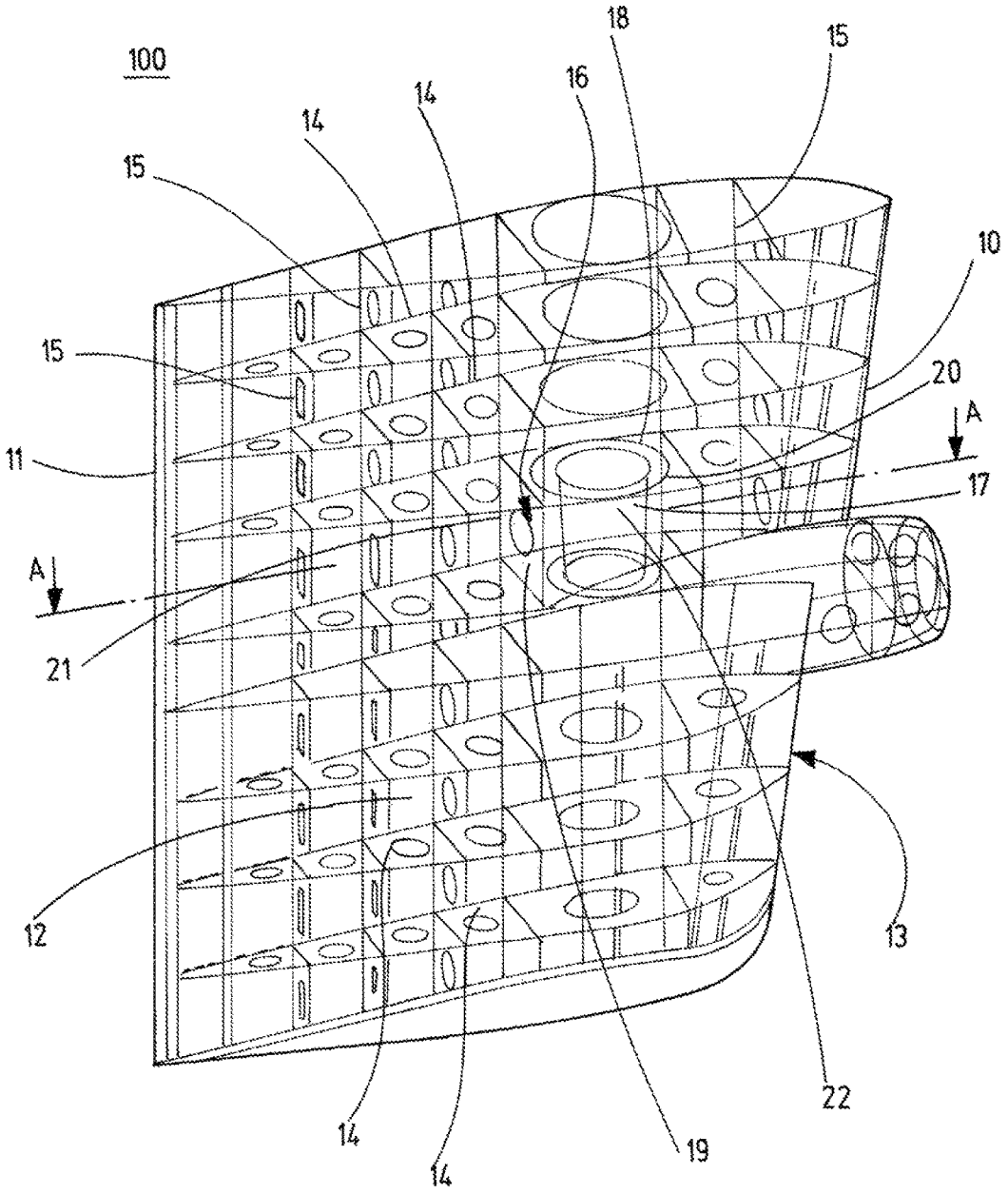
FIG. 1 shows a perspective skeleton illustration of a rudder blade.
Figure 2:
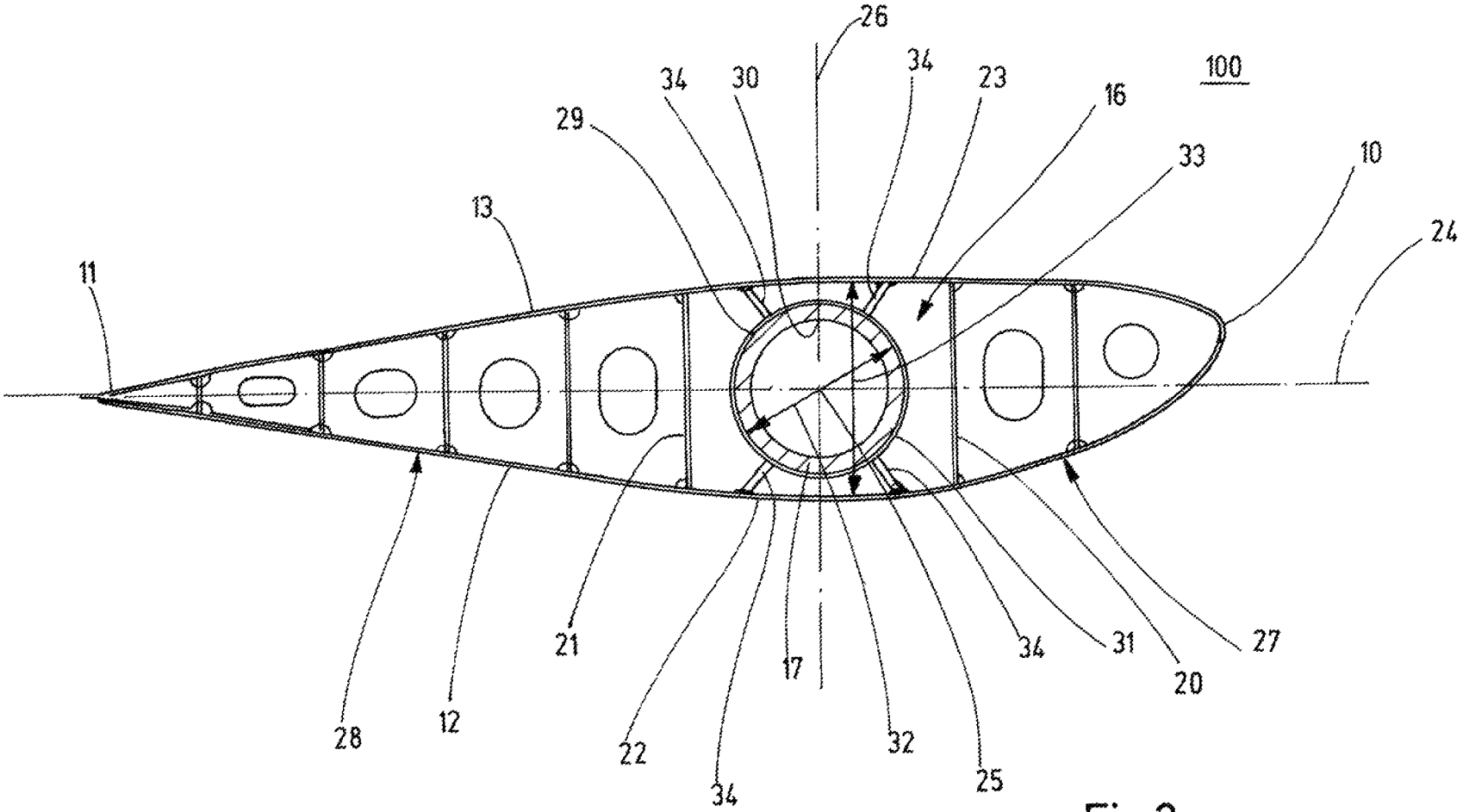
FIG. 2 shows a profile section through a rudder blade.

FIG. 1 shows a rudder blade 100, with a leading edge 10, a trailing edge 11, a first side wall 12 and a second side wall 13 lying opposite the first side wall 12 (FIG. 2). Horizontal ribs 14 and vertical ribs 15, which ensure the nondeformability of the rudder blade 100, are arranged in the interior of the rudder blade 100. A connection space 16 with a rudder blade hub 17 arranged therein is provided approximately in the centre of the rudder blade 100. The connection space 16 is bounded upwards in the vertical direction by a partial region of an upper rib 18 and downwards, as seen in the vertical direction, by a partial region of a lower rib 19. The connection space 16 is bounded forwards in the direction of the leading edge 10 by a partial region of a front rib 20 and is bounded rearwards in the direction of the trailing edge 11 by a partial region of a rear rib 21. The connection space 16 is bounded on the outer sides by a partial region, designed as a first outer wall 22, of the first side wall 12 and by a partial region, designed as a second outer wall 23 (FIG. 2), of the second side wall 13.

FIG. 2 shows a section along the line A-A in FIG. 1 level with the rudder blade hub 17. The rudder blade hub 17 is arranged in the interior of the connection space 16. The rudder blade 100 is of approximately symmetrical design in relation to a centre plane 24, wherein deviations from the symmetry arise by means of the leading edge 10 which is twisted with respect to the centre plane 24 and to a certain extent is rotated out of the centre plane 24. The longitudinal axis 25 of the rudder blade hub 17 runs perpendicularly to the plane of the figure. An imaginary transverse plane 26 which divides the rudder blade 100 into a front region 27 and a rear region 28 runs perpendicularly to the centre plane 24 and through the longitudinal axis 25 of the rudder blade hub 17. The rudder blade hub 17 is arranged in the region of the greatest profile thickness of the rudder blade 100. The rudder blade hub 17 comprises a hub body 29 with an inner bore 30. The inner bore 30 is designed for receiving a rudder stock (not illustrated in FIG. 2). The hub body 29 furthermore has a hub outer surface 31 running in the circumferential direction. The hub outer surface 31 is arranged here in its entirety spaced apart from the inner side of the first outer wall 22 and the inner side of the second outer wall 23. The hub body 29 has an outer diameter 32 which is smaller than the inner distance 33 between the inner side of the first outer wall 22 and the inner side of the second outer wall 23. Connecting means 34 are arranged on the hub outer surface 31 over the circumference of the hub body 29.

Figure 3:
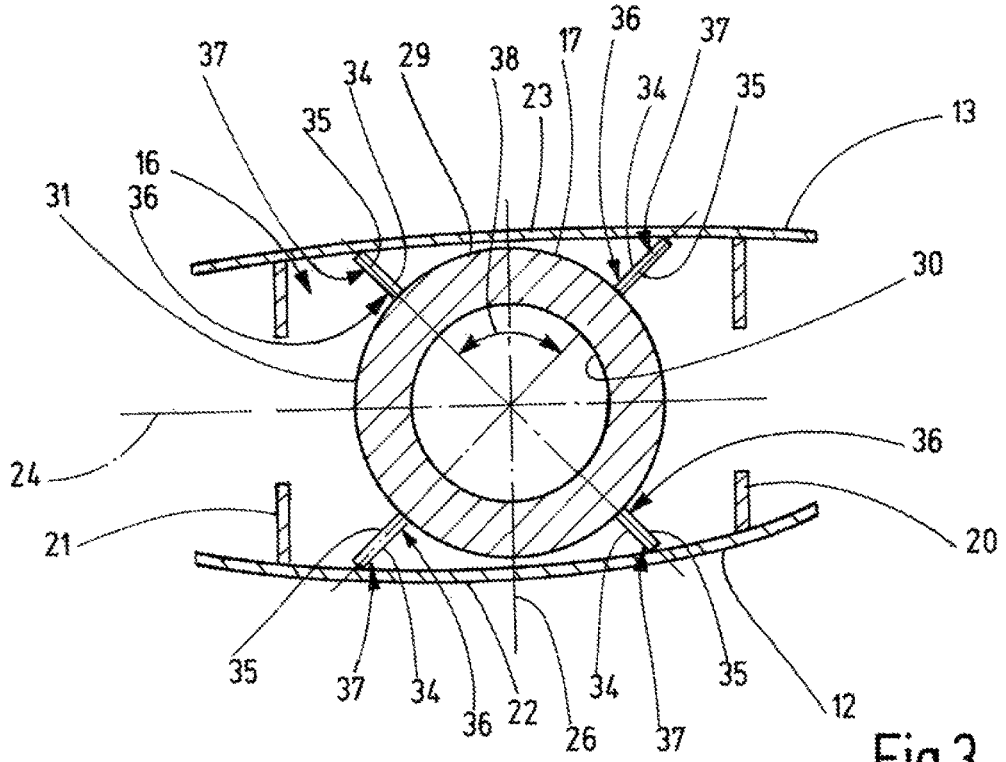
FIG. 3 shows a top view of a connection space of a first rudder blade with a rudder blade hub arranged therein.

The rudder blade hub 17 with the hub body 29 and connecting means 34 is illustrated in enlarged form in FIG. 3. The connecting means 34 are in the form of plates 35 and are of approximately cuboidal design. Each connecting means 34 is welded with a first connecting region 36 to the hub outer surface 31 and with a second connecting region 37 to the inner side of the first outer wall 22 or to the inner side of the second outer wall 23. The connecting means 34 therefore extend between the hub outer surface 31 and the inner side of the first outer wall 22 or the inner side of the second outer wall 23. The connecting means 34 which are designed as plates 35 are arranged substantially symmetrically with respect to the centre plane 24, and therefore the same number of connecting means 34 is arranged on both sides of the centre plane 24. The connecting means 34 serve to transmit or to conduct away forces and torques acting on the side walls 12, 13 during operation of the rudder blade 100 to the hub body 29 of the rudder blade hub 17 and to a rudder stock arranged in the inner bore 30 of the hub body 29 and to impart sufficient strength to the rudder blade 100.

In the embodiment illustrated in FIG. 3, the connecting means 34 are also arranged uniformly over the circumference of the hub outer surface 31, and therefore an angular distance 38 of 90° is provided between each two adjacently arranged connecting means 34.

Figure 4:
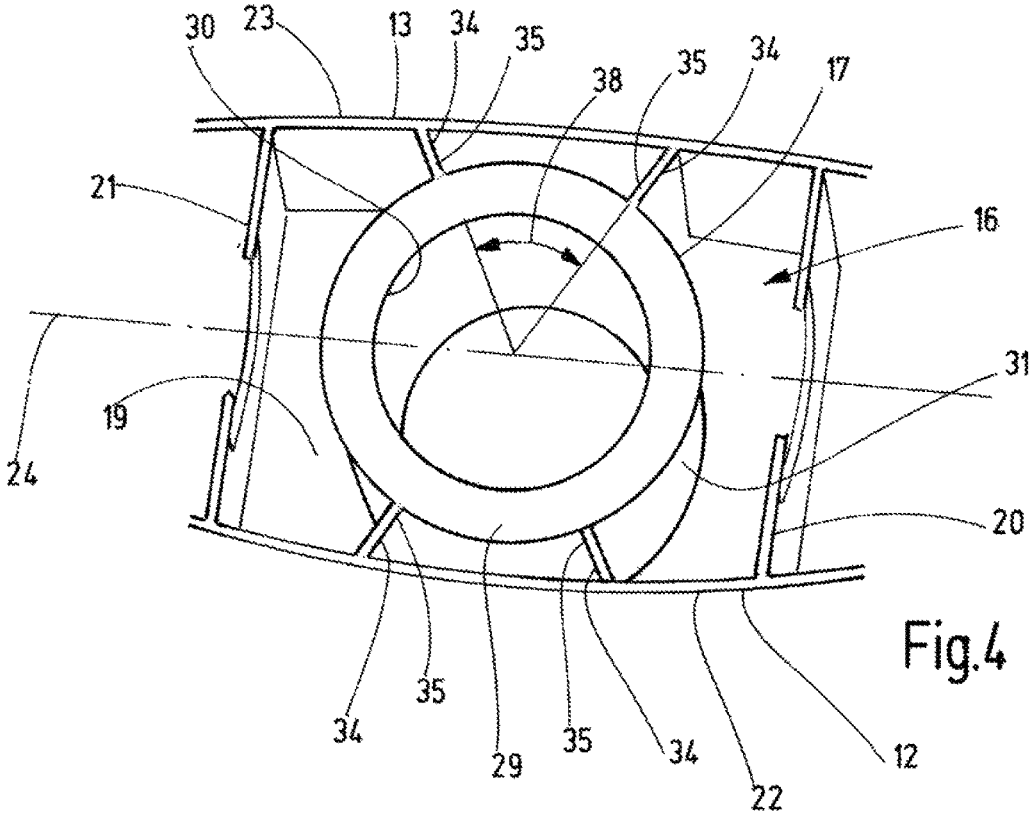
FIG. 4 shows a top view of a connection space of a second rudder blade with a rudder blade hub arranged therein.

An alternative arrangement of the connecting means 34 is shown in FIG. 4. In each case two connecting means designed as plates 35 are arranged on both sides of the centre plane 24. The angular distance 38 between each two connecting means 34 lying on one side of the centre plane 24 is between 50° and 70° here.

Figure 5:
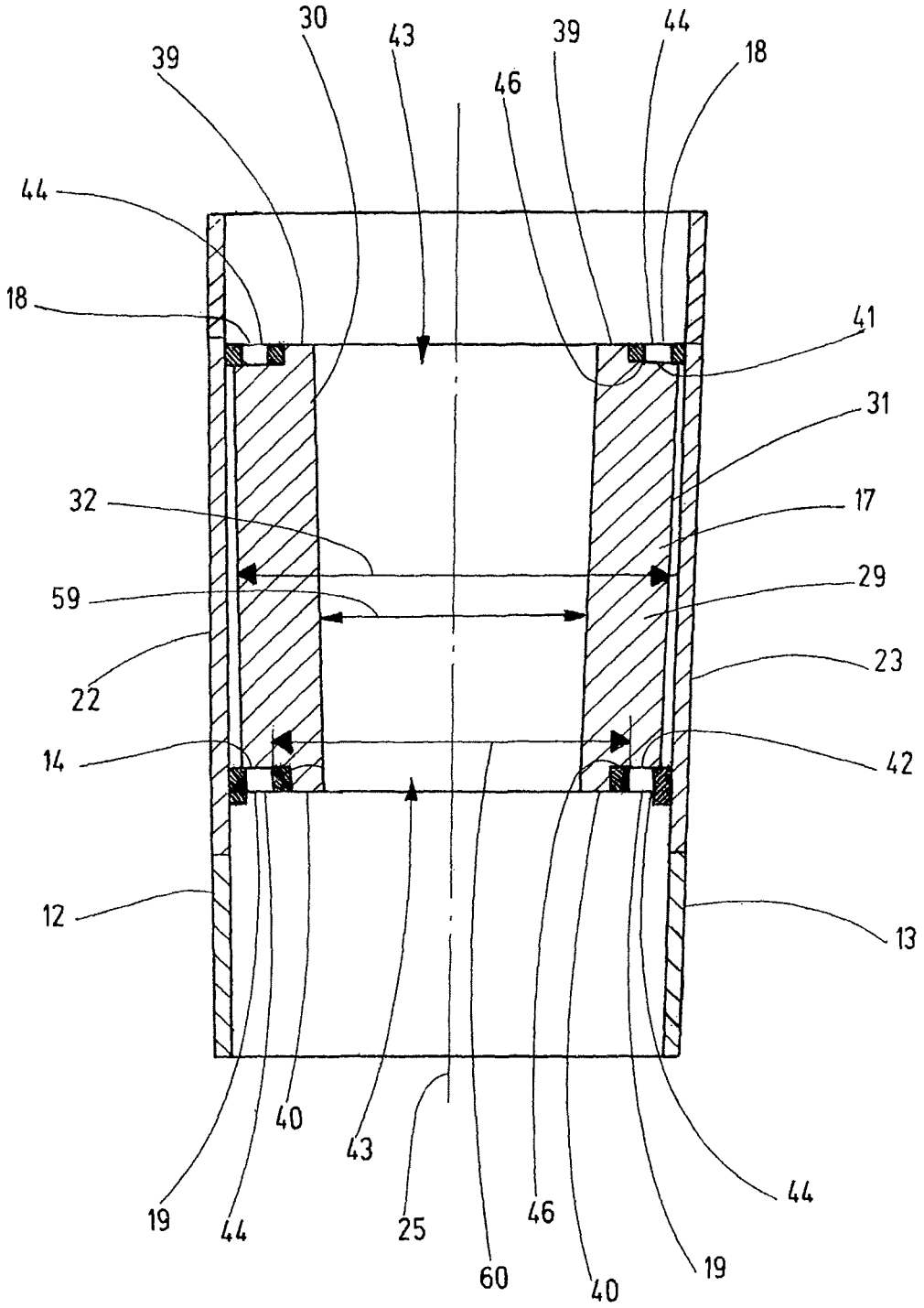
FIG. 5 shows a cross section through a connection space of a rudder blade.

FIG. 5 shows a section through the transverse plane 26 of FIG. 2 and FIG. 3. The connecting means 34 are not illustrated in FIG. 5 because of the sectional plane. The hub body 29 of the rudder blade hub 17 is of approximately conical design and tapers downward in the vertical direction. As can be seen, the hub outer surface 31 is arranged spaced apart from the inner side of the first outer wall 22 and the inner side of the second outer wall 23. As seen in the axial direction of the longitudinal axis 25 of the rudder blade hub 17, the hub body 29 has an upper front side 39 and a lower front side 40. The hub body 29 lies with a region of the upper front side 39 against the lower side 41 of an upper rib 18 and with a region of a lower front side 40 against the upper side 42 of a lower rib 19. The upper rib 18 and the lower rib 19 each have an opening 43, and therefore a rudder stock (not illustrated) can be inserted into the inner bore 30 of the hub body 29. The openings 43 are each bounded by a flange 44 which is connected to the first side wall 12, or to the first outer wall 22, and to the second side wall 13, or to the second outer wall 23. In order to produce the connection, the upper front side 39 and the lower front side 40 of the hub body 29 have an encircling step 46 or an encircling shoulder. The hub body 29 engages by means of the steps 46 on the upper front side 39 and the lower front side 40 in the respective opening 43 in the upper rib 18 and in the lower rib 19. The hub body 29 is connected to the flanges 44 in the region of the upper front side 39 or the lower front side 40. The diameter 60 of the openings 43 is smaller than the outer diameter 32 of the hub body 29 and larger than the inner diameter 59 of the inner bore 30 of the hub body 29.

Figure 6:
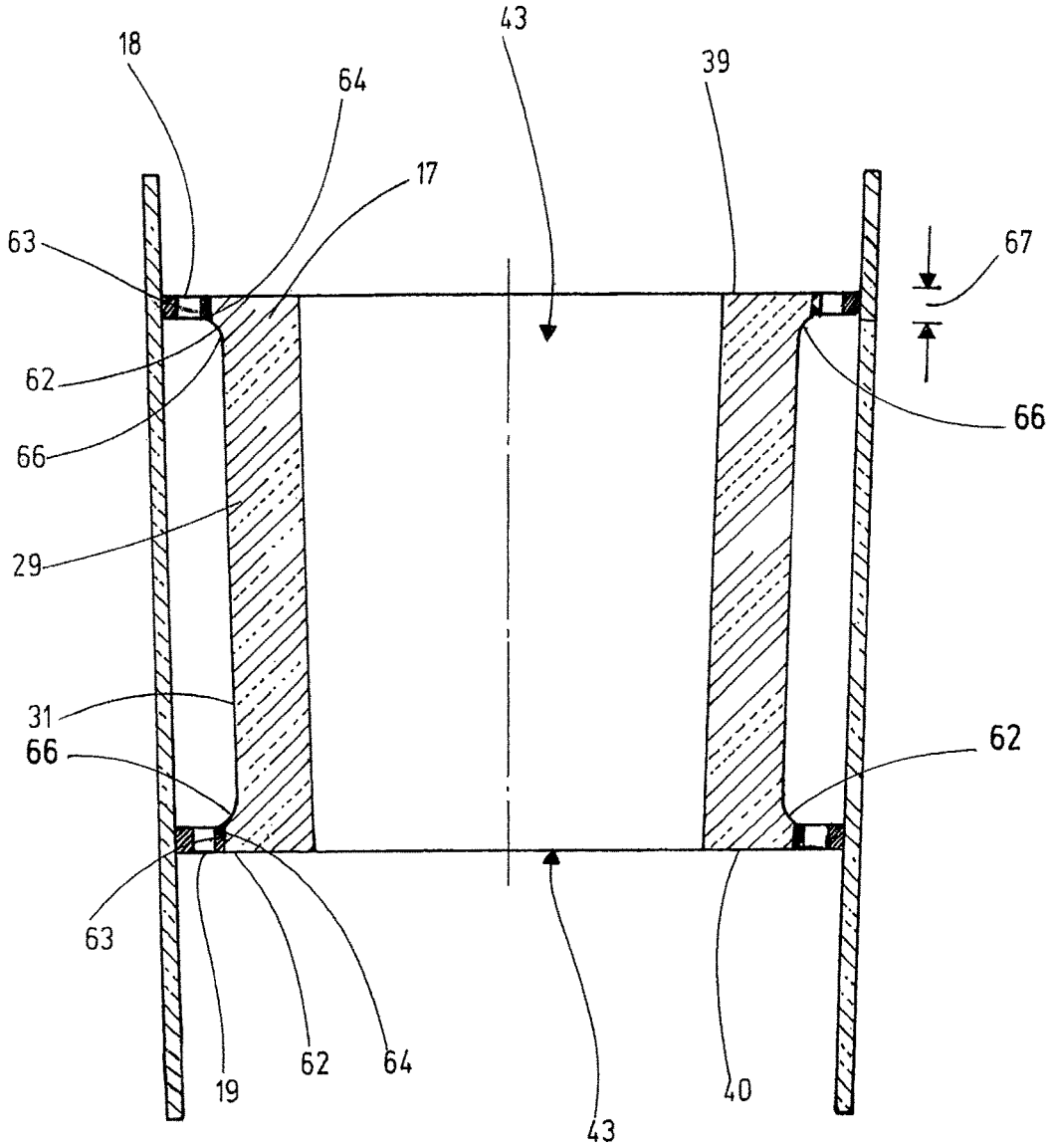
FIG. 6 shows a further cross section through a connection space of a rudder blade.

FIG. 6 illustrates a section through the transverse plane 26 of FIG. 2 and FIG. 3, wherein the connection of the hub body 29 of the rudder blade hub 17 to the upper rib 18 and to the lower rib 19 differs from the configuration according to FIG. 5. In the region of the upper front side 39 and the lower front side 40, the hub body 29 of FIG. 6 in each case comprises a projection 62 which encircles the hub outer surface 31 and is connected to an outer surface 63 on an inner side 64 of the upper rib 18 and/or of the lower rib 19. The encircling projection 62 has a transition radius 66 here. The transition radius is preferably between 5 and 10 cm, furthermore preferably between 5 and 7 cm, in particular preferably 6 cm.

When the hub body 29 is connected to the upper rib 18 or lower rib 19, the hub body 29 projects over a length, which approximately corresponds to the height 67 of the projection 62, into the opening 43 in the upper rib 18 or the lower rib 19.

The invention claimed is:

1. A rudder blade for water ships, comprising:

a leading edge, a trailing edge, a first side wall and a second side wall lying opposite the first side wall; and a rudder blade hub which is arranged in a connection space for connecting a rudder stock, wherein the connection space is provided in an interior of the rudder blade, wherein the rudder blade hub comprises a hub body, wherein the hub body comprises an inner bore for receiving a rudder stock, and a hub outer surface running in the circumferential direction;

wherein the hub outer surface is arranged in its entirety, spaced apart from an inner side of the first side wall and from an inner side of the second side wall.

2. A rudder blade according to claim 1, wherein the hub outer surface is arranged spaced apart from the inner side of the first side wall and from the inner side of the second side wall over the entire axial height of the rudder blade hub, and/or in that the hub outer surface does not have any physical contact with the inner side of the first side wall and the inner side of the second side wall, and/or in that the hub body has an outer diameter, in that the connection space comprises a first outer wall, wherein the first outer wall is a partial region of the first side wall, in that the connection space comprises a second outer wall, wherein the second outer wall is a partial region of the second side wall, in that the connection space has an inner distance between an inner side of the first outer wall and an inner side of the second outer wall, wherein the outer diameter of the hub body is smaller than the inner distance.

3. A rudder blade according to either of claim 1 or 2, wherein the rudder blade hub comprises at least one connecting means, wherein the at least one connecting means extends between the hub outer surface and the inner side of the first side wall and/or the inner side of the second side wall.

4. A rudder blade according to claim 3, wherein the at least one connecting means is designed to transmit forces and/or torques acting on the rudder blade to the hub body during operation and when the rudder blade is arranged on the ship.

5. A rudder blade according to claim 3, wherein the at least one connecting means comprises a first connecting region and a second connecting region, wherein the at least one connecting means is arranged and/or fastened with the first connecting region on/to the hub outer surface, and wherein the at least one connecting means is arranged and/or fastened with the second connecting region on/to the inner side of the first side wall and/or on/to the inner side of the second side wall.

6. A rudder blade according to claim 1, wherein at least two connecting means are provided, wherein the at least two connecting means are arranged symmetrically or asymmetrically with respect to a centre plane of the rudder blade, and/or in that an equal number of connecting means are arranged on both sides of the centre plane, and/or in that the number of connecting means which extend between the hub outer surface and the inner side of the first side wall is equal to the number of connecting means which extend between the hub outer surface and the inner side of the second side wall.

7. A rudder blade according to claim 3, wherein the at least one connecting means extends over at least 60%, of the axial height of the rudder blade hub and is arranged and/or fastened on/to the hub outer surface over at least 60%, of the axial height.

8. A rudder blade according to claim 3, wherein the at least one connecting means is a web and/or a plate and/or a strut.

9. A rudder blade according to claim 3, wherein between two and ten, connecting means are provided, wherein the connecting means are arranged symmetrically or asymmetrically with respect to the centre plane of the rudder blade and/or are arranged distributed uniformly over the circumference of the hub body.

10. A rudder blade according to claim 3, wherein at least two connecting means are provided, wherein the at least two connecting means have an angular distance of 0° to 90° from the centre plane of the rudder blade, and/or wherein the at least two connecting means have an angular distance of 0° to 90° from a transverse plane running perpendicularly to the centre plane of the rudder blade and through a longitudinal axis of the rudder blade hub, and/or in that in each case two connecting means are arranged on each side of, and symmetrically with respect to, the centre plane, wherein the angular distance between the two connecting means arranged on the respective side is between 20° and 120°.

11. A rudder blade according to claim 3, wherein the at least one connecting means is welded and/or adhesively bonded to the hub outer surface and/or to the side walls of the rudder blade and/or is forged thereon.

12. A rudder blade according to claim 1, wherein the hub body is formed in a rotationally symmetrical manner with respect to a longitudinal axis of the rudder blade hub, wherein the hub body is of cylindrical or conical design, and/or in that the rudder blade comprises ribs, in that the hub body has a lower front side and an upper front side, and in that the hub body is fastened with the lower front side to a first lower rib, and/or in that the hub body is fastened with the upper front side to a second upper rib.

13. A rudder blade according to claim 3, wherein the ratio of the outer diameter of the hub body to an inner diameter of the inner bore is between 1.0 and 2.0.

14. A rudder blade hub for a rudder blade according to claim 1.

15. A construction kit for a rudder blade hub according to claim 14 comprising a hub body and at least one connecting means.

16. A rudder blade according to claim 3, wherein the rudder blade hub comprises at least two connecting means, wherein a first connecting means extends between the hub outer surface and the inner side of the first side wall and wherein a second connecting means extends between the hub outer surface and the inner side of the second side wall.

17. A rudder blade according to claim 12, wherein the at least one connecting means is fastened with a first end side to the first lower rib, and/or in that the at least one connecting means is fastened with a second end side lying opposite the first end side to the second upper rib.

* * * * *